US005573410A

United States Patent [19]

Stepniak

[11] Patent Number: 5,573,410

[45] Date of Patent: Nov. 12, 1996

[54] VARIABLE SIZE ENTRY INSERT FOR CABLE ACCESSORIES AND METHOD

[75] Inventor: Frank M. Stepniak, Andover, N.J.

[73] Assignee: Amerace Corporation, Hackettstown, N.J.

[21] Appl. No.: 396,477

[22] Filed: Mar. 2, 1995

[51] Int. Cl.[6] ..... H01R 4/58

[52] U.S. Cl. ..... 439/88; 29/883

[58] Field of Search ..... 439/88, 89, 183, 439/281, 161, 523, 921, 604, 587, 589, 274, 275; 29/883, 885

[56] References Cited

U.S. PATENT DOCUMENTS 4,210,381 7/1980 Borgstrom ..... 439/161

4,643,506 2/1987 Kobler ..... 439/587

4,946,393 8/1990 Borgstrom et al. ..... 439/88

*Primary Examiner*—Neil Abrams

*Assistant Examiner*—Yong Kim

*Attorney, Agent, or Firm*—David Teschner, Esq.

[57] ABSTRACT

A pre-molded insert for a high voltage cable accessory is formed near its entry with an interior annular recess or notch which permits the insert end to be deflected towards the central axis. The insert end in conjunction with a properly sized mandrel allows the same insert to be used with high voltage cables having a range of exterior diameters.

5 Claims, 3 Drawing Sheets

VARIABLE SIZE ENTRY INSERT FOR CABLE ACCESSORIES AND METHOD

BACKGROUND OF THE INVENTION

1. Field of the Invention

The invention is directed to the manufacture of accessories for high voltage cable and more particularly to the manufacture of accessories wherein the insulation layer of the accessory must be in contact with the bared cable insulation to obtain the required electrical performance and provide a water seal.

2. Description of the Prior Art

In prior art devices, such as that shown in U.S. Pat. No. 4,210,381 issued Jul. 1, 1980 and assigned to the assignee of the instant invention and shown in FIG. 1 of this application which is FIG. 2 of that patent, a pre-molded semi-conductive layer 52, which is an elastomeric material with carbon black added, is placed in a mold (not shown) and a pre-molded semi-conductive insert 54 is placed inside of layer 52. A mandrel used to support insert 54, is dimensioned so that it's outside diameter matches the inside diameter of insert 54. The interstices between layer 52 and insert 54 are now filled with a non-conductive elastomeric layer 55. No gaps are permitted between the insert, the outer layer or the insulation as these could prevent proper electrical functioning or permit water or other contaminants to enter the accessory along bore 56. Thus for each size of cable and each type of accessory there must be a correctly sized insert.

SUMMARY OF THE INVENTION

The instant invention overcomes the difficulties noted above with respect to the known prior art devices by providing an insert with an entry which can be varied in size so that the insulation about the entry into such insert can be varied to match the particular cable diameter. The insert is provided, adjacent its entry, with an annular recess or notch on the interior surface of the insert which permits the portion of the insert between such annular recess and the end of the insert to be deflected inwardly thus decreasing the diameter of the entry into the insert. A mandrel of the diameter described by the end of the inwardly deflected end of the insert is inserted into the insert and the non-conductive layer molded with the result that the cable entrance into the insert and the bore 56 are decreased giving a proper interference fit for a smaller diameter cable inserted into the accessory. It is an object of this invention to provide an improved cable accessory insert.

It is an object of this invention to provide an improved cable accessory insert and employ same in the manufacture of cable accessories.

It is another object of this invention to provide an insert for a cable accessory whose entry diameter can be varied.

It is yet another object of this invention to provide an insert for a cable accessory whose entry diameter can be varied and employ same in the manufacture of cable accessories.

Other objects and features of the invention will be pointed out in the following description and claims and illustrated in the accompanying drawings, which disclose, by way of example, the principles of the invention and the best mode presently contemplated for carrying them out.

BRIEF DESCRIPTION OF THE DRAWING

In the drawing in which similar elements are given similar reference characters.

DESCRIPTION OF THE PREFERRED EMBODIMENT

Turning now to FIGS. 2 to 5 there is shown an insert constructed in accordance with the concepts of the invention and which is employed to form housings for accessories that provide the correct engagement of the housing insulation with the cable insulation.

Figure 1:
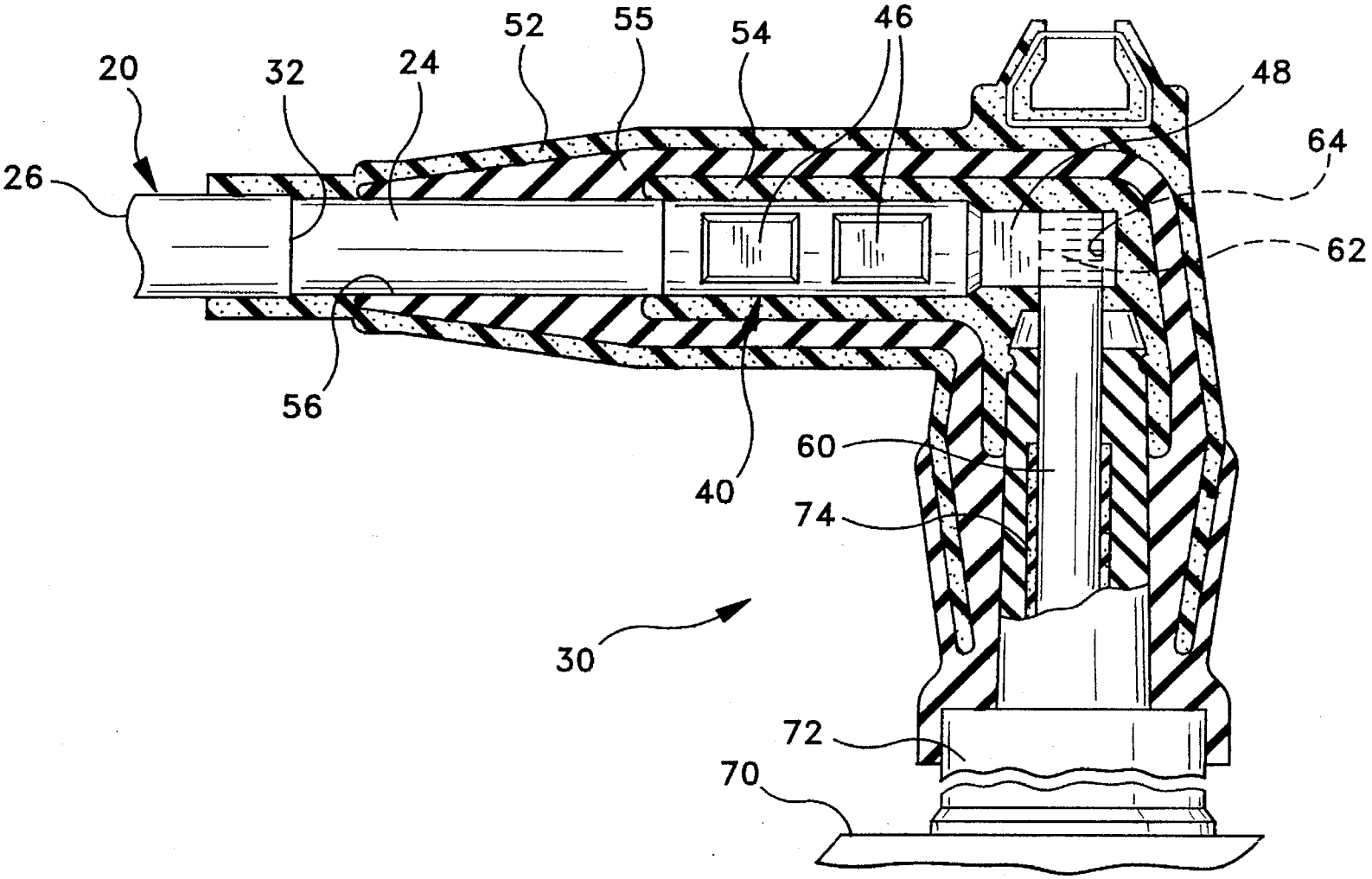
FIG—1 PRIOR ART
FIG. 1 is a side elevational view, in section, of a high voltage cable elbow according to the prior art and is FIG. 2 of U.S. Pat. No. 4,210,381 as above identified.
Figure 2:
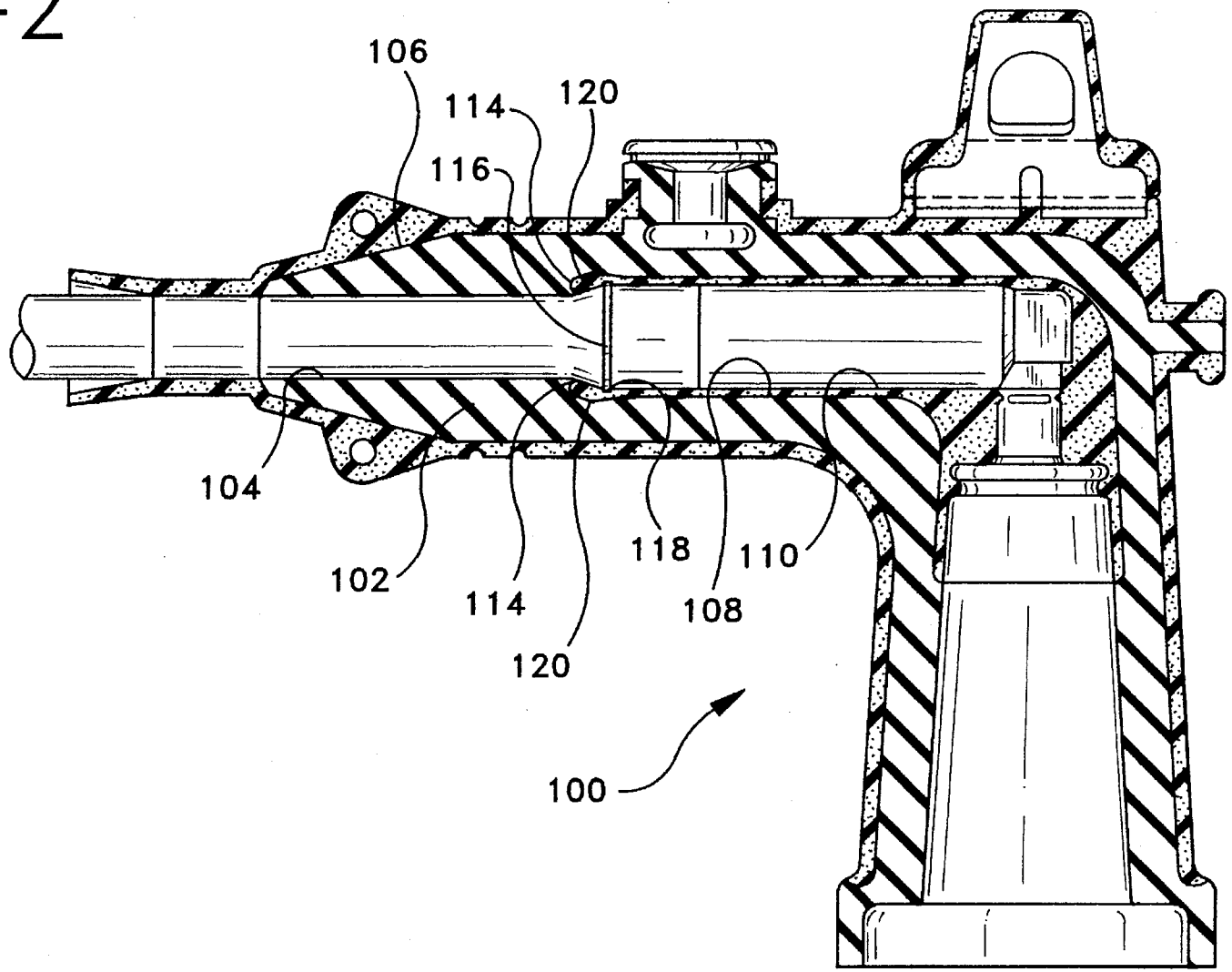
FIG. 2 is a side elevational view, in section, of an elbow constructed in accordance with the concepts of the invention.

FIG. 2 shows a cable elbow 100 which has a non-conductive insulating elastomeric layer 102 within which extends a bore 104. The diameter of bore 104 is selected so that there is an interference fit between the walls of layer 102 which define bore 104 and the exposed insulation of a properly prepared high voltage cable (not shown). The interference fit with the cable insulation provides proper electrical properties and a water seal as is well known in the art. Placed about insulation layer 102 and with a void-free interface with layer 102 is a semi-conductive shield layer 106, made of semi-conductive elastomeric. A semi-conductive insert 108 is placed inside of the insulating layer 102. Within the bore 110 of insert 108 is positioned a cable connector (not shown). In the prior art, as shown in FIG. 1, the entry to insert 54 is straight with an interior diameter equal to the cable 20, insulation layer 24 outside diameter. If a different diameter cable is to be used, an insert 54 with the correct inside diameter must be used during manufacture of the elbow 30.

In actual manufacture, the premolded semi-conductive layer 52 is placed in the mold. A pre-molded insert 54 is placed in the mold. A mandrel, having the outside diameter of the desired inside diameter of bore 56 is placed within layer 52 up to the entrance to insert 54. The interstices are then filled with insulative elastomeric to form insulation layer 55. The mandrel is withdrawn and used again and thus does not burden the manufacturing operation as does requiring a number of inserts in a number of different sizes.

Figure 3:
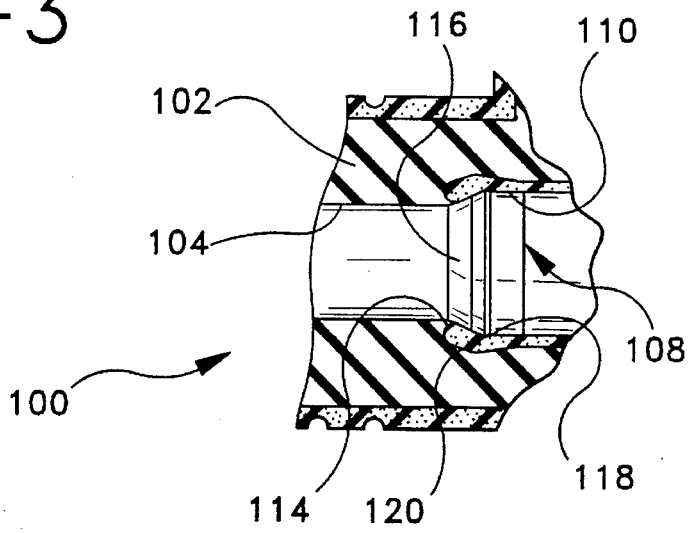
FIG. 3 is a fragmentary enlargement of a portion of the device of FIG. 2, in section, to better illustrate the details of the inventive insert.

Insert 108, as shown in FIGS. 2 and 3 has an end annular edge 114 which describes the entry 116 into the bore 110 of inset 108. An annular recess or notch 118 extends about the interior of insert 108 and defines a deflectable insert end 120 which can be deflected inwardly towards the central longitudinal axis of insert 108 to decrease the entry diameter 116. The mandrel (not shown) outer diameter is selected such that cable bore 104 in the insulation layer 102 provides the proper interference fit. The mandrel edge engages annular edge 114.

Figure 4:
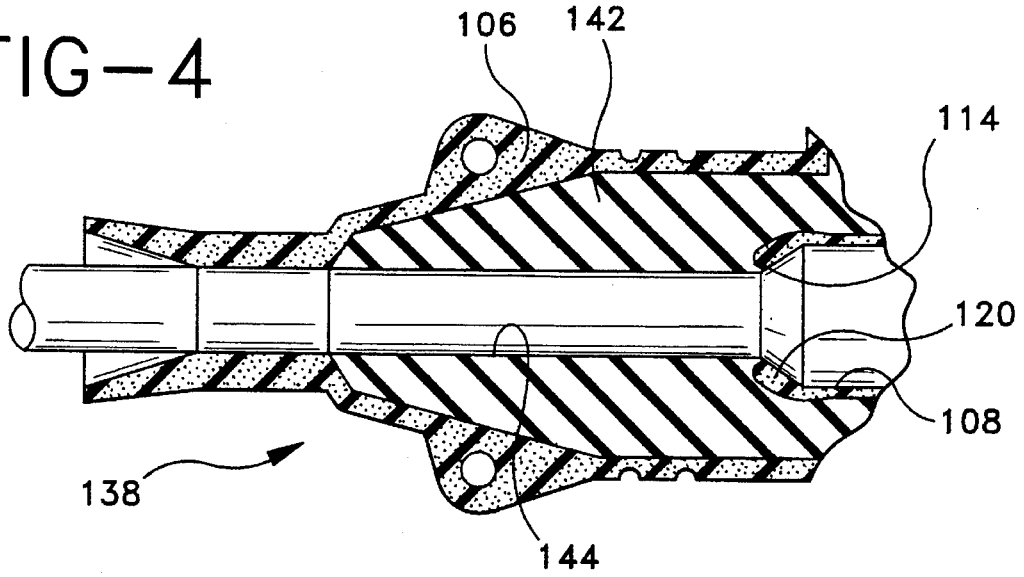
FIG. 4 is a fragmentary, side elevational view, in section, of the insert of FIG. 2 positioned for a cable of a diameter smaller than that of FIG. 2.

To use the same pre-molded shield layer 106 in the device 138 of FIG. 4 with a cable having an insulation layer of a diameter less than the diameter of bore 104, the deflectable insert end 120 is deflected so as to put annular edge 114 closer to the axis and decrease the diameter of entry 116. A smaller diameter mandrel (not shown) is inserted in the mold (not shown) until its end engages edge 114. The insulation layer 142 is now added and the resulting bore 144 of the insulation layer 142 is smaller in diameter than bore 104 of device 100 of FIG. 2. By using a rounded insert end 120, the insulation can flow in behind end 120 and fill the voids without trapping air or providing a sharp edge which could cause local stress build-up.

Figure 5:
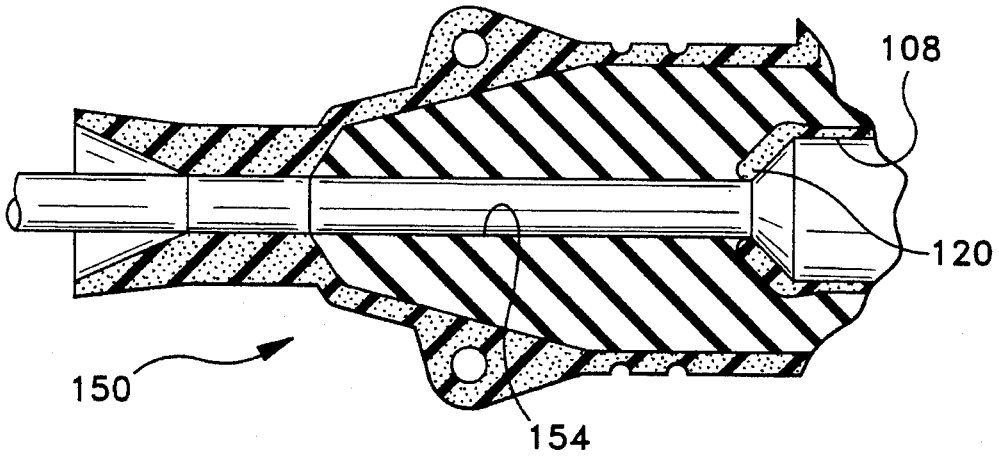
FIG. 5 is a fragmentary, sided elevational view, in section, of the insert of FIG. 2 positioned for a cable of a diameter smaller than that of FIG. 4.

To form the device 150 of FIG. 5 to use the shield layer 106 with an accessory to be placed upon a still smaller diameter cable, the insert ends 120 can be positioned still closer to the central axis of insert 108, and a proper sized mandrel placed against edge 114 to determine the insulation diameter which can be accommodated by bore 154. Of course the insert end 120 can be placed at any position from that shown in FIGS. 2 and 3 to that shown in FIG. 5 or closer to the central axis. The insert ends 120 will not be deflected outwardly away from the central axis because that could lead to voids where air could collect or sharp edges to be produced both of which could increase the electrical stress locally.

While there have been shown and described and pointed out the fundamental novel features of the invention as applied to the preferred embodiments, it will be understood that various omissions and substitutions and changes of the form and details of the device illustrated and in its operation may be made by those skilled in the art, without departing from the spirit of the invention.

The embodiments of the invention in which an exclusive property or privilege is claimed are defined as follows:

1. An insert for use in the manufacture of a high voltage cable accessory having a body portion with a first bore therein, said first bore having a first end and a second end, said insert comprising:

a) a first end and a second end, said first end of said insert positioned in said body portion adjacent said second end of said first bore;

b) said insert having a second bore therethrough and communicating with said first bore of said body portion;

c) an annular recess in said insert adjacent said second bore and adjacent said first end of said insert to define a weakened region; and d) the portion of said insert between said annular recess and said first end of said insert being deflectable towards the central longitudinal axis of said insert to control the diameter of the entry into said second bore, said deflectable portion of said insert being fixed in position by the formation of said body portion about said insert.

2. An insert as defined in claim 1, wherein said first end of said insert is rounded.

3. An insert as defined in claim 1, wherein said portion of said insert between said recess and said first end deflects symmetrically.

4. A method of manufacturing a cable accessory having a premolded outer part, a body portion having a first bore therein, said first bore having a first end and a second end and an insert having a first end and a second end and a second bore therethrough, said first end of said insert being adjacent said second end of said first bore and said second bore communicating with said first bore, a portion of said insert adjacent said first end of said insert being deflectable towards the central longitudinal axis of said insert to decrease the diameter of the entrance into said second bore comprising the steps of:

a) placing said premolded outer part in a mold cavity;

b) deflecting said portion of said insert inwardly towards said central longitudinal axis by a first amount;

c) placing said insert in said mold cavity and within a portion of said premolded outer part;

d) inserting a mandrel of a first predetermined diameter into said mold cavity within at least a portion of said premolded outer part and adjacent said insert first end; and e) filling the interstices between said premolded outer part, said insert and said mandrel with moldable material to complete said accessory whereby said first bore is of said first predetermined diameter.

5. The method of manufacturing a cable accessory as defined in claim 4, comprising the additional steps of:

a) deflecting said portion of said insert inwardly towards said central longitudinal axis a greater amount than said first amount;

b) inserting a mandrel of a second predetermined diameter into said mold cavity within a least a portion of said premolded outer part and adjacent said insert first end; and c) filling the interstices with moldable material whereby said first bore is of said second predetermined diameter.

* * * * *